US006470729B1

(12) United States Patent
Hughes et al.

(10) Patent No.: US 6,470,729 B1
(45) Date of Patent: Oct. 29, 2002

(54) REPAIR TOOL

(75) Inventors: John R. Hughes, Manchester, MI (US); Steven Hamilton, South Lyon, MI (US); Mark P. Palleschi, Livonia, MI (US); James D. Becker, Dearborn Heights, MI (US)

(73) Assignee: Ford Motor Company, Dearborn, MI (US)

( * ) Notice: Subject to any disclaimer, the term of this patent is extended or adjusted under 35 U.S.C. 154(b) by 0 days.

(21) Appl. No.: 09/683,868

(22) Filed: Feb. 25, 2002

Related U.S. Application Data

(60) Provisional application No. 60/272,927, filed on Mar. 2, 2001.

(51) Int. Cl.[7] ..... B21D 5/08

(52) U.S. Cl. ..... 72/479; 72/176; 29/243.57; 29/275

(58) Field of Search ..... 72/176, 479; 29/34 R, 29/275, 243.57

(56) References Cited

U.S. PATENT DOCUMENTS 2,547,391 A * 4/1951 Hauschild ..... 72/479
2,637,292 A * 5/1953 George ..... 72/479
2,810,420 A * 10/1957 Gibson ..... 72/479
3,541,836 A * 11/1970 Meis ..... 72/479
4,148,205 A * 4/1979 Boysen ..... 72/479
5,457,981 A * 10/1995 Brown et al.
5,634,251 A * 6/1997 Kraft
6,161,410 A * 12/2000 Shook et al.
6,257,043 B1 * 7/2001 Wiens
2001/0029766 A1 * 10/2001 Wiens

* cited by examiner

*Primary Examiner*—David Jones
(74) *Attorney, Agent, or Firm*—Gigette Bejin

(57) ABSTRACT

An opening tool is provided for separating an outer panel of a tailgate, decklid, door or the like from an interior panel in a repair process. The opening tool may work in conjunction with a closing tool which operates to re-secure the outer panel to the interior panel once the necessary repairs have been completed. The removal tool includes a mounting arm, a blade, a shoulder and optionally, a scratch resistor. The mounting arm may be adaptable to be mounted upon an air hammer. Upon removal of the outer door panel, the blade is wedged between the outer door panel and the interior door panel. The blade is integral to the mounting arm and the shoulder. As the blade travels along the hem flange in the removal process, the shoulder maintains the position of the blade as it separates the outer door panel from the interior door panel.

10 Claims, 7 Drawing Sheets

REPAIR TOOL

CROSS REFERENCE TO RELATED APPLICATIONS

This application claims the benefit of U.S. Provisional application Ser. No. 60/272,927, filed Mar. 2, 2001.

BACKGROUND OF INVENTION

1. Field of the Invention

The present invention relates to the field of repair, service, and/or assembly tools, and more particularly to a tool for removing an outer body panel from a vehicle.

2. Background of the Invention

Vehicles generally include doors, hoods, trunk deck lids and tailgates which each have one unitary outer panel of sheet metal. The outer panel of sheet metal is joined to a second inner reinforcing panel of sheet metal by hemming a flange over and along the edge the door, hood or deck lid.

Hemming the unitary outer panel of sheet metal to the vehicle components is generally a time-intensive and labor-intensive process. Repair shops must generally replace the outer skin of vehicle panels where the panels are damaged or where corrosion has formed on the vehicle.

In the assembly of the doors and the like, the first stage of the hemming process includes nesting the inner panel within the outer panel fixture on an anvil die on a base of a prehemming machine. Once the assembly has been fixtured, a tool called a hemming steel engages and bends an edge of the outer panel to an acute angle with respect to the inner panel. The second stage of the hemming process involves transferring the assembly to a second hemming machine which completely bends the prehemmed edge of the outer panel over the edge of the inner panel to secure and attach the panels together as a unitary structural member for assembly on a vehicle. An adhesive is applied between the inner panel and the folded-over edge of the outer panel. Occasionally, corrosion or damage may occur to the vehicle requiring the removal of the outer door panel in the repair process.

The repair process for vehicle doors/hoods/deck lids/tailgates has traditionally been equally time-intensive and labor-intensive due to the construction of the doors/hoods/deck lids/tailgates. In order to replace the outer panel, a user must grind the outer panel at the edge of the door near the hem flange. Upon grinding the outer panel, the outer panel is removed in pieces and must be completely replaced. However, this process not only destroys an outer panel which may be repairable, but takes a significant amount of time and effort.

Consequently a need has developed for a repair system and method to easily remove the outer panels of a vehicle without damaging the outer panel in the process.

SUMMARY OF INVENTION

It is a principal object of the present invention to provide a repair system and method to easily remove and re-install the outer panels of a vehicle.

It is yet another object of the present invention to provide a removal tool to lift up a hem flange and a closing tool to close a hem flange without scratching the paint on the outer panel.

It is still another object of the present invention to provide a removal tool which is adapted for mounting onto an airgun in order to reduce the amount of time and effort required to lift a hem flange away from an inner panel.

It is still another object of the present invention to provide a left-handed version of a removal tool suitable for removal of a left-side door of vehicle and a right-handed version of a removal tool suitable for removal of a right-side door of a vehicle.

It is yet another object of the present invention to reduce the removal and re-installment time for the repair of a vehicle door and/or hem flange.

In accordance with the above objects and other objects and features of the present invention, a tool is provided to easily open the hem flange on vehicle doors, tailgates and the like so that the outer door panel may be removed for repair and subsequently re-installed saving time and money. The tool of the present invention is a removal tool which may operate in conjunction with a closing tool. The removal tool includes a mounting arm, a blade, a shoulder and optionally, a scratch resistor. The removal tool is preferably but not necessarily mounted to an air gun. The blade is integral to the shoulder and the mounting arm. The blade is operative to lift the hem flange away from the inner panel. The shoulder is operative to maintain the position of the blade as the blade travels down the hem flange. The blade and the shoulder join at the mounting arm and are integral to each other. The shoulder may further include a scratch resistor to prevent paint removal from the outer skin as the shoulder abuts the outer skin and travels against the outer skin. The scratch resistor may consist of a reinforced nylon plastic component which is seated within a recess defined by the shoulder. The scratch resistor may also consist of a coating on the shoulder.

A closing tool may also be provided in conjunction with the removal tool. This tool includes a recess and a handle. The recess is defined by an upper lip and a lower lip and is operative to receive an open or partially open flange and the inner panel. Upon receiving the open or partially open hem flange and the inner panel in the recess, the hem flange is closed and sealed against the inner panel. The upper lip and the lower lip join at a connecting member and are integral to the connecting member. The connecting member further extends away from the upper lip and the lower lip to define a handle.

As those skilled in the art will recognize, the embodiments of this invention may vary depending upon the specific requirements of a vehicle. Accordingly, the particular size and shape of the mounting arm, blade, shoulder, and scratch resistor of the removal tool in addition to the upper lip, lower lip, connecting member and handle of the closing tool may vary, depending on the particular application.

The above objects and other objects, features, and advantages of the present invention are more readily understood from a review of the attached drawings and accompanying specification.

BRIEF DESCRIPTION DRAWINGS

DETAILED DESCRIPTION

Figure 1:
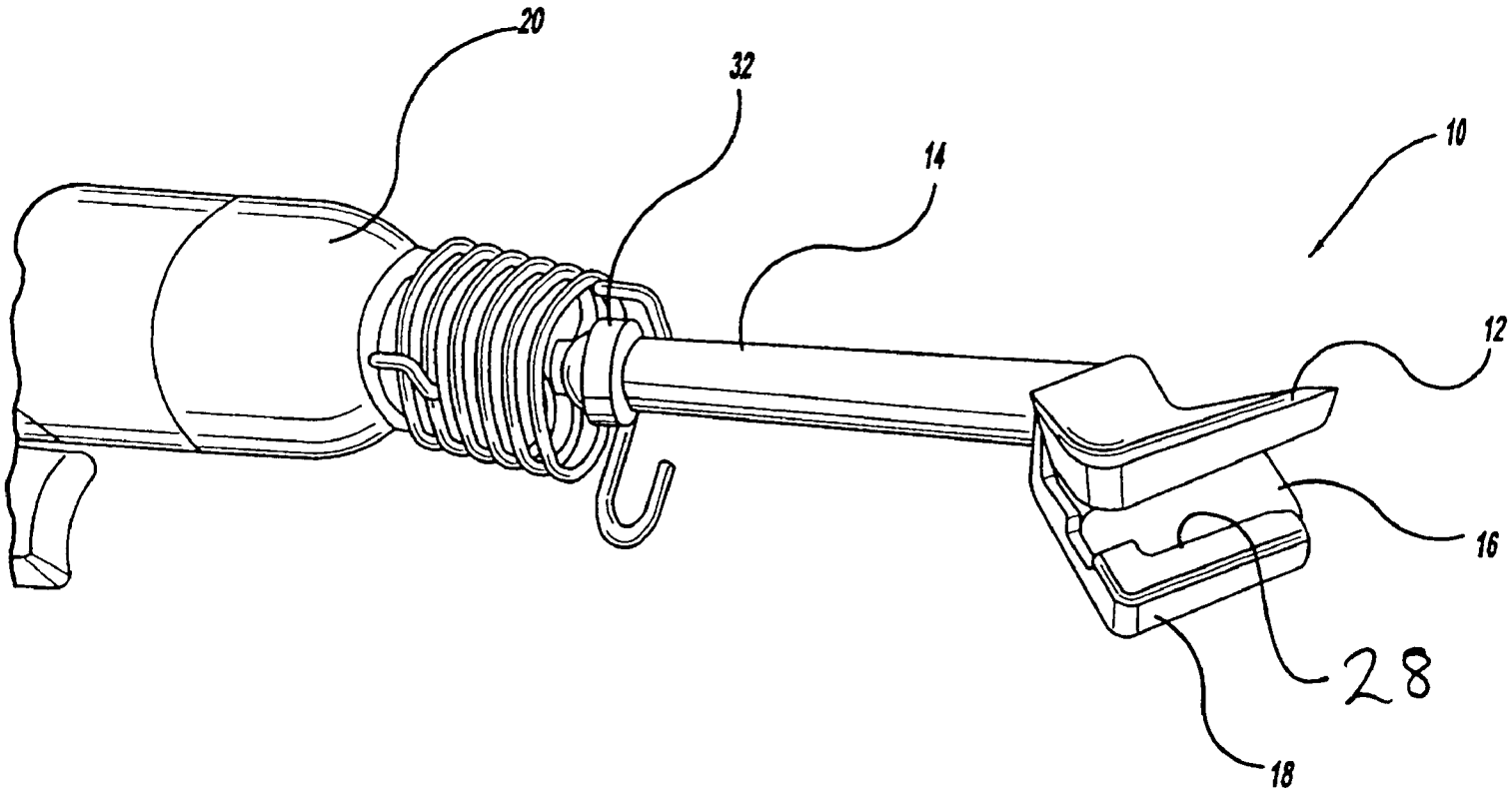
FIG. 1 is a perspective view of a first side of the removal tool.
Figure 2:
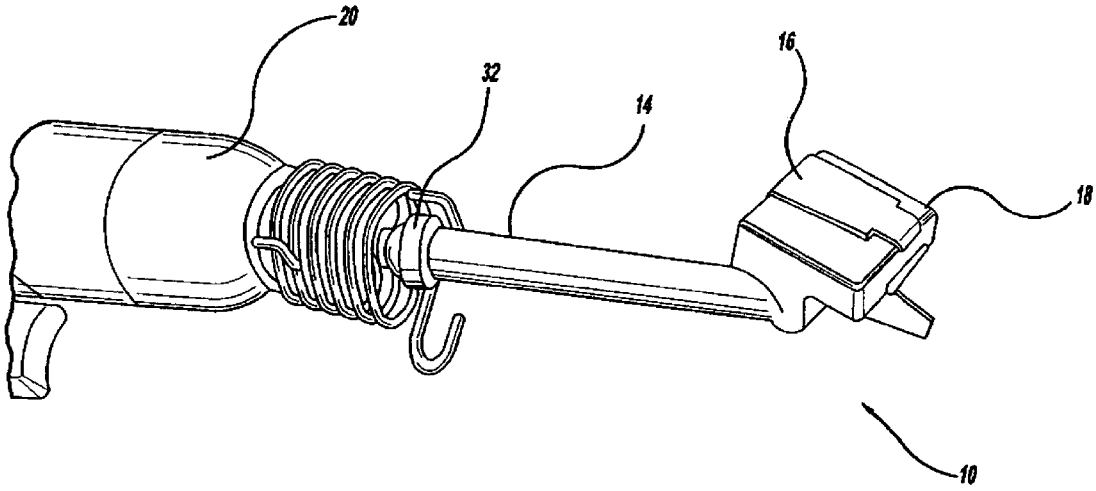
FIG. 2 is a perspective view of a second side of the removal tool.

With reference to FIGS. 1 and 2, the removal tool 10 is shown. The opening tool 10 includes a blade 12, a mounting arm 14, scratch resistor 16, and a shoulder 18. The mounting arm 14, as shown in FIG. 1, is operative to mount the removal tool 10 to an air gun 20. With reference to FIG. 1, in lieu of the mounting arm 14, a handle may be used so that the tool may be manually operated.

Figure 3:
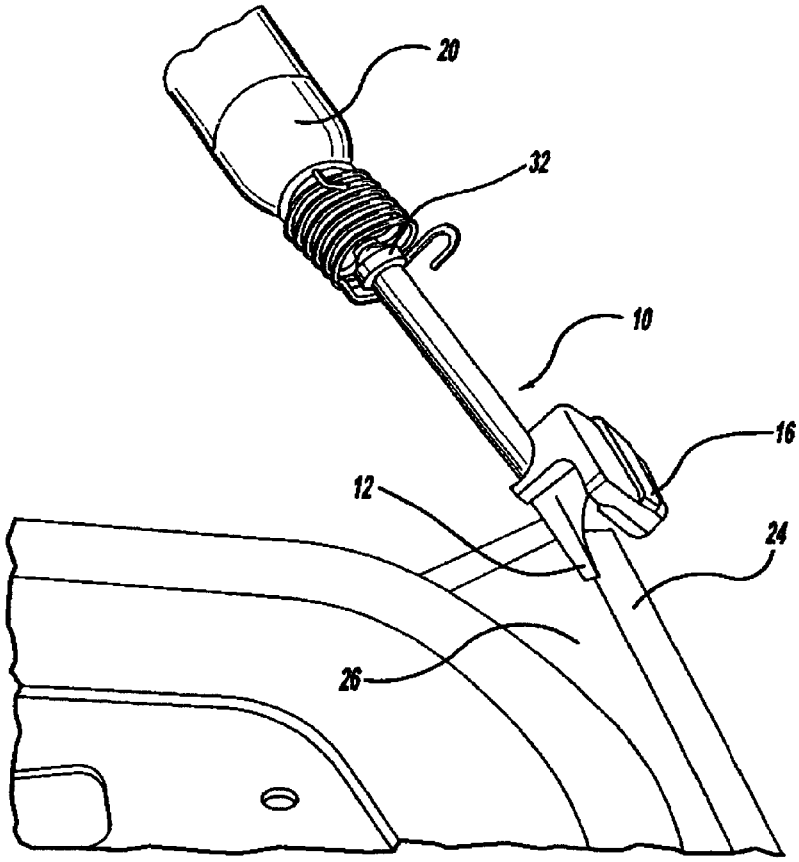
FIG. 3 is a side view of the removal tool inserted onto an already closed weld flange.
Figure 4:
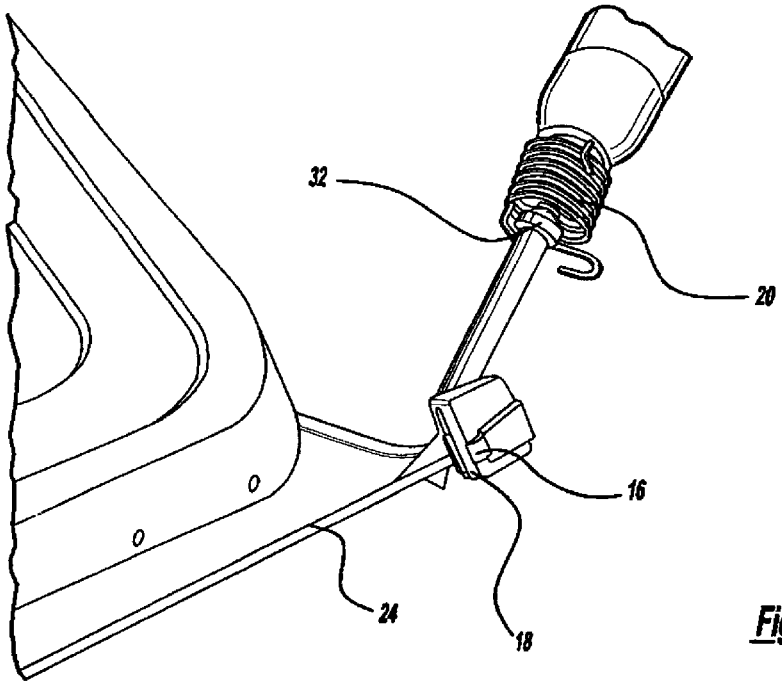
FIG. 4 is a side view of the removal tool inserted onto a closed weld flange.

The blade 12, the mounting arm 14, and the shoulder 18 are integral to each other and may, but not necessarily, be formed of 4140 Steel. Referring now to FIGS. 3 and 4, In operation, the blade 12 of the opening tool 10 is inserted between the door inner 26 and hem flange 24. As the opening tool 10 and air gun 20 travel along the edge of the door 26 at the hem flange 24, the hem flange 24 is opened away from the inner panel or door inner 26. The shoulder 18 of the removal tool 10 maintains the position of the blade 12 under the hem flange 24 as the removal tool 10 travels along the hem flange 24.

Referring back to FIGS. 1–4, the shoulder 18 of the opening tool lo may include a scratch resistor 16. The scratch resistor 16 may, but not necessarily, be a nylon-reinforced plastic component. Where the scratch resistor 16 is a nylon-reinforced plastic component, the scratch resistor 16 may sit in a recess 28 defined by the shoulder 18. The scratch resistor 16 may be removably affixed to the shoulder 18 so as to prevent the removal of paint as the removal tool lo lifts the hem flange 24 (shown in FIG. 3). The scratch resistor 16 may be replaced from time to time as the scratch resistor 16 is worn and scratched due to normal use. One alternative to a separate plastic component, the scratch resistor 16 may be made up of a plastic coating around the shoulder 18 to prevent the removal of paint as the shoulder travels against the outer skin or panel of the vehicle. As recognized by those skilled in the art, the scratch resistor 16, which prevents paint removal, may take various forms.

As shown in FIGS. 1–4, the mounting arm 14 may also include a projection 32 to properly seat the removal tool 10 to an air gun 20 or a handle 22. It is preferable but not necessary to mount the removal tool 10 to an air gun 20 to reduce the effort required to raise the hem flange 24.

Figure 5:
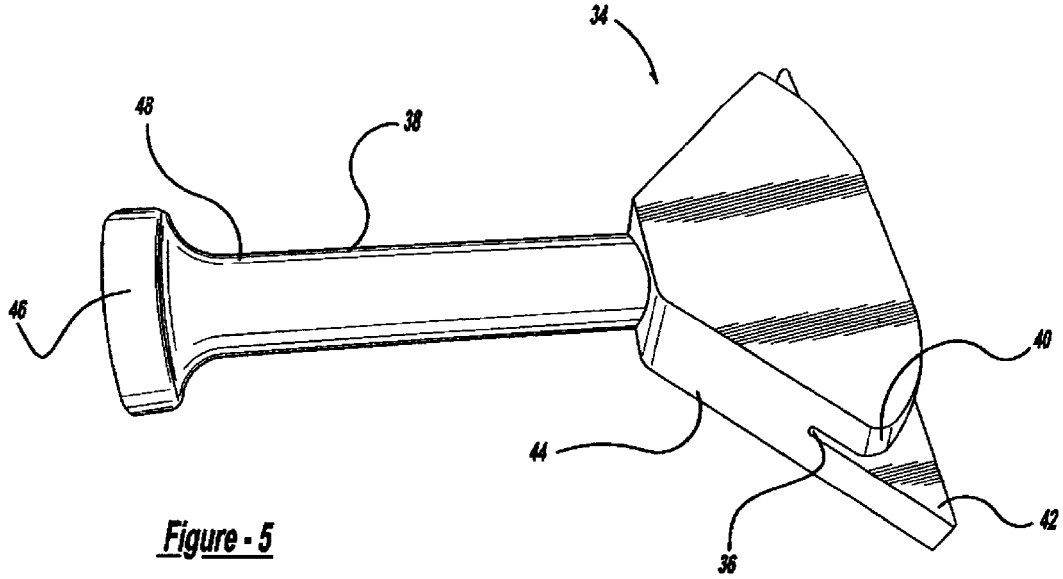
FIG. 5 is a perspective view of a first side of the closing tool.
Figure 6:
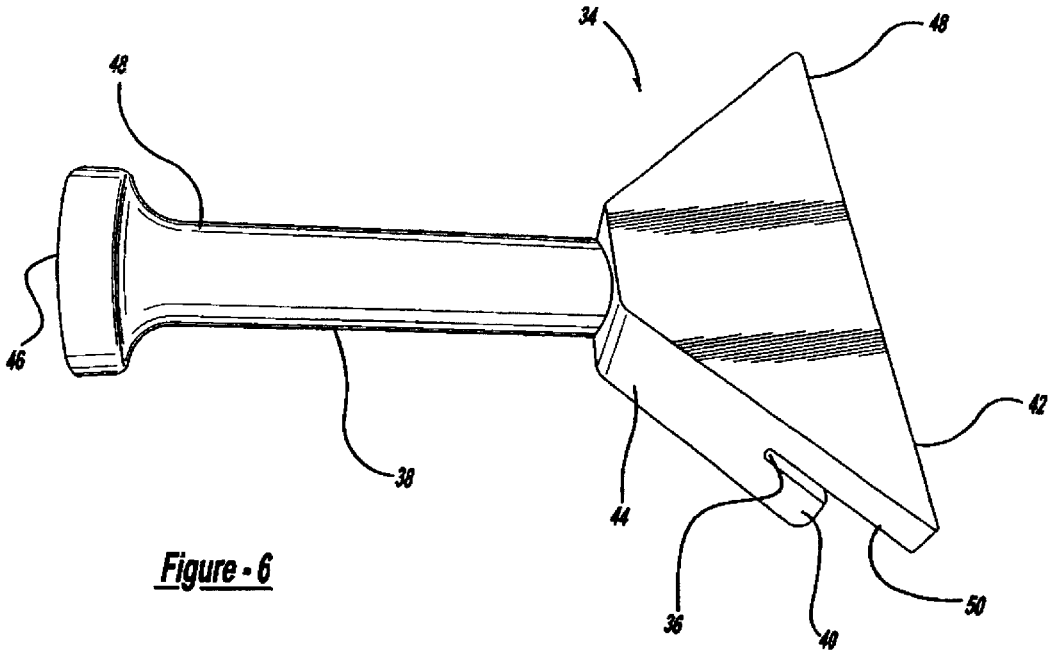
FIG. 6 is a perspective view of a second side of the closing tool.

Referring now to FIGS. 5 and 6, the closing tool 34 is illustrated. As shown, the closing tool 34 includes a receptacle 36 and a shaft 38. The receptacle 36 is defined by an upper or first planar projection 40 and a lower or second planar projection 42. The receptacle 36 is operative to receive an open or partially open hem flange 24 (shown in FIG. 7) and the door inner or inner panel 26 (shown in FIG. 7). The first projection 40 and the second projection 42 join at a connecting member 44 and are integral to the connecting member 44. The connecting member may be mounted onto a shaft 38, or in the alternative, may be integral to the connecting member 44 so that a user may manually maintain the position of the closing tool 34. The shaft 38 further includes a base 46 at its lateral end 48 to receive an impact from hammer 52 (shown in FIG. 7) or the like.

As shown in FIGS. 5 and 6, the second projection 42 may be longer than the first projection 40 in predetermined areas 48, 50 in order to permit the closing 34 tool to easily receive a partially open hem flange and door inner.

Figure 7:
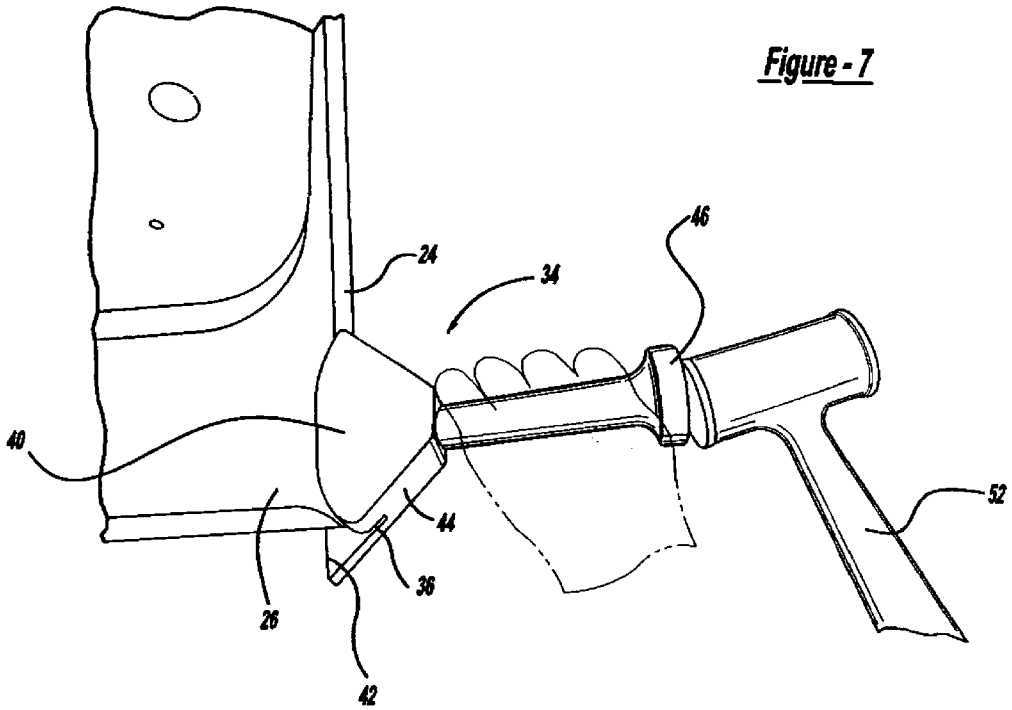
FIG. 7 is a perspective view of a hem flange inserted within the closing tool.

Referring now to FIG. 7, the closing tool 34 receives the hem flange 24 and the inner panel 26 in the receptacle 36 between the first projection 40 and the second projection 42. In receiving the hem flange 24 and the inner panel 26, it is preferable to surround the hem flange 24 and the inner panel 26 such that the hem flange 24 and inner panel 26 abut the connecting member 44 upon impact of the hammer 52. As shown in FIG. 7, the manually operated hammer 52 may exert an impact onto the base 46 of the closing tool 34 in order to close the partially open or open hem flange 24.

While the best modes for carrying out the invention have been described in detail, those familiar with the art to which this invention relates will recognize various alternative designs and embodiments for practicing the invention. The words used in the specification are words of description rather than limitation, and it is understood that various changes may be made without departing from the spirit and the scope of the invention.

What is claimed is:

1. A tool for removing an outer door panel from an interior door panel, the outer door panel being joined to the inner door panel by a hem flange, the tool comprising:

a blade adapted for insertion between an outer door panel and an inner door panel at the hem flange;

an arm integral to the blade;

a shoulder integral to the arm and the blade, the shoulder being operative to maintain the position of the blade as the blade travels down the hem flange; and a scratch resistor mounted on the shoulder.

2. The tool defined in claim 1, wherein the scratch resistor is a plastic coating around the shoulder.

3. The tool defined in claim 1, wherein the shoulder defines a recess for receiving the scratch resistor.

4. The tool defined in claim 3 wherein the scratch resistor is a plastic insert.

5. A tool for removing an outer door panel from an interior door panel, the outer door panel being joined to the inner door panel by a hem flange, the tool comprising:

a blade adapted for insertion between an outer door panel and an inner door panel at the hem flange;

an arm integral to the blade, the arm being adapted for mounting on an air hammer;

a shoulder integral to the arm and the blade, the shoulder being operative to maintain the position of the blade as the blade travels down the hem flange; and a scratch resistor mounted on the shoulder.

6. The tool defined in claim 5 wherein the scratch resistor is a plastic coating around the shoulder.

7. The tool defined in claim 5 wherein the shoulder defines a recess for receiving the scratch resistor.

8. The tool defined in claim 5 further comprising a projection integral to the mounting arm, the projection being operative to properly seat the removal tool to an air gun.

9. The tool defined in claim 7 wherein the scratch resistor is a plastic insert.

10. A repair tool for removing an outer door panel from an interior door panel at a hem flange, the repair tool comprising:

a blade being operative to separate an outer door panel from an inner door panel;

an arm integral to the blade, the arm being adaptable to receive an air hammer;

a plastic insert; and a shoulder being integral to the blade and the arm, the shoulder defining a recess for receiving the plastic insert.

* * * * *